US008886111B2

(12) United States Patent
Tharayil et al.

(10) Patent No.: US 8,886,111 B2
(45) Date of Patent: Nov. 11, 2014

(54) QUAD-ROLL MEDIA CURLING APPARATUS, SYSTEMS, AND METHODS

(75) Inventors: Marina Tharayil, Rochester, NY (US); Injae Choi, Webster, NY (US); Joannes N. M. deJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 13/372,134

(22) Filed: Feb. 13, 2012

(65) Prior Publication Data

US 2013/0209152 A1 Aug. 15, 2013

(51) Int. Cl.
*G03G 15/00* (2006.01)
*B65H 29/20* (2006.01)

(52) U.S. Cl.
USPC ..... 399/406; 399/397; 271/314

(58) Field of Classification Search
CPC ..... B65H 2301/5121
USPC ..... 399/406, 397; 271/314
See application file for complete search history.

(56) References Cited

U.S. PATENT DOCUMENTS

| | | | | |
|---|---|---|---|---|
| 4,326,915 | A | 4/1982 | Mutschler, Jr. | |
| 4,475,896 | A | 10/1984 | Bains | |
| 5,123,895 | A | 6/1992 | Mandel | |
| 5,392,106 | A | 2/1995 | Bigenwald et al. | |
| 5,848,347 | A * | 12/1998 | Kuo et al. | 399/406 |
| 6,816,229 | B2 * | 11/2004 | Oono | 355/18 |
| 7,641,193 | B2 | 1/2010 | Barinaga et al. | |
| 2005/0068410 | A1 * | 3/2005 | Kama | 347/223 |
| 2009/0218757 | A1 * | 9/2009 | Terashima | 271/225 |

* cited by examiner

*Primary Examiner* — Daniel J Colilla
*Assistant Examiner* — John M Royston
(74) *Attorney, Agent, or Firm* — Ronald E. Prass, Jr.; Prass LLP

(57) ABSTRACT

A quad-roll curler apparatus includes a first roll, a second roll, a third roll, and a fourth roll. The curler apparatus is adjustable to a first processing configuration wherein three of the four rolls are engaged to impart a curl in a sheet in a first direction. The curler apparatus is adjustable to a second sheet processing configuration wherein three of the four rolls are engaged to impart a curl in a sheet in a second direction that is different from the first direction.

10 Claims, 4 Drawing Sheets

QUAD-ROLL MEDIA CURLING APPARATUS, SYSTEMS, AND METHODS

RELATED APPLICATION

This Application is related to co-pending U.S. patent application Ser. No. 13/372,071 ("MEDIA CURLING APPARATUS AND SYSTEMS INCLUDING TRI-ROLL MEDIA CURLER") by Choi et al., filed on Feb. 13, 2012, the same day as the present Application. The disclosure of U.S. patent application Ser. No. 13/372,071 is incorporated herein by reference in its entirety.

FIELD OF DISCLOSURE

The disclosure relates to media curling apparatus and systems for curling and decurling media in printing systems. In particular, the disclosure relates to apparatus and systems for curling and/or decurling media using a bi-directional four-roll media curler.

BACKGROUND

Related art media curling systems include indentation, belt, and/or baffle-type curlers. An indentation curler as shown in FIG. 1A includes a soft roll 105 having an elastomeric surface that deforms under pressure applied by a penetrating roll 115, which is a hard roll that is urgable against the soft roll 105. An indentation-type curler typically requires a large force to be applied by the penetrating roll for deforming the soft roll 105, and media interposing the hard roll 115 and the soft roll 105.

A related art belt-type curler as shown in FIG. 1B includes a belt 107 entrained by one or more belt rolls 110. A penetrating roll 115 is urgable against the belt 107 for deforming media carried by the belt 107. The indentation or belt-type curler may be sufficient for light weight paper. For heavier weight paper, however, a more substantial belt deformation may be necessary to accommodate a desired deformation of media carried by the belt 107, which may lead to premature system failure. Belt tracking issues may be problematic for heavier paper jobs.

A related art baffle-type curler as shown in FIG. 1C includes a first soft outer roll 112, a penetrating roll 115, a second soft outer roll 117, and an idler roll 120. The idler roll 120 and the first outer roll 112 define a nip entrance through which paper is fed through a narrow paper path comprising a baffle and the penetrating roll 115. The penetrating roll 115 is configured to be movable toward the baffle for bending and pushing the paper between the first outer roll 112 and the second outer roll 117, or between a roll and the baffle. The baffle-type curler may be less effective for lighter weight paper, which must be bent to have a smaller radius than is necessary for heavier weight paper. The baffle-type curler also has a configuration that curls paper while leaving larger lead edge and trail edge lengths more unaffected than those of paper curled by other related art curlers.

Moreover, the above-discussed related art curling systems are configured for imparting a curl in a sheet in a single direction. Related art systems are not suitable for imparting a curl in a sheet that extends in either a first direction or a second direction, wherein the first direction is different than, e.g., opposite from the first direction. Similarly, related art systems are not suitable for imparting a plurality of curls in a sheet wherein the at least two of the plurality of curls extend in opposite directions.

SUMMARY

A media curler that accommodates both light weight paper and heavy weight paper is disclosed by Choi et al. in related U.S. patent application Ser. No. 13/372,071 ("MEDIA CURLING APPARATUS AND SYSTEMS INCLUDING TRI-ROLL MEDIA CURLER"). The media curler disclosed by Choi et al. may be implemented for imparting one or more curls in a sheet wherein the one or more curls are formed in a same direction. Apparatus, and systems for imparting more than one curl in a single sheet wherein the plurality of curls may face same and/or different direction(s)—e.g., upward and/or downward, or wherein a curl in either an upward or downward direction may be applied to a sheet being processed in a same process direction are disclosed.

An embodiment of four-roll curler apparatus may include an inlet roll; an exit roll; a first penetrating roll; and a second penetrating roll, each of which defining a paper path interposing the first and second penetrating rolls, and the inlet roll and the exit roll. In an embodiment, a four-roll curler apparatus may be configured for imparting an up-curl in a sheet wherein the first penetrating roll may be movable, a distance between the inlet roll and the second penetrating roll being fixed. A four-roll curler apparatus may be configured for imparting a down-curl in a sheet wherein the second penetrating roll may be movable, wherein a distance between the first penetrating roll and the exit roll is fixed. A four-roll curler apparatus may impart one or more curls in a single sheet wherein the curl(s) are arranged in a same or different direction(s)—e.g., upward and/or downward.

In an embodiment, curler apparatus may include a first roll; a second roll; a third roll; and a fourth roll, wherein the first roll, the second roll, the third roll, and the fourth roll define a sheet processing path, the first roll and the second roll being arranged on a first side of the sheet processing path, and the third roll and the fourth roll being arranged on a second side of the sheet processing path, the rolls being configured for curling a sheet. Apparatus may include the first roll, the second roll, the third roll, and the fourth roll being adjustable to a first processing configuration and a second processing configuration, whereby the first processing configuration accommodates curling a sheet in a first direction, and the second processing configuration accommodates curling a sheet in a second direction.

In an embodiment, apparatus may include the first roll, the second roll, the third roll, and the fourth roll being selectively engageable. Apparatus may include the first processing configuration including the first roll, the second roll, and the third roll being operably positioned for imparting a curl in a sheet in the sheet processing path. In an embodiment, the third roll may be a penetrating roll, the penetrating roll being movable toward and away form the sheet processing path.

In an embodiment, apparatus may include the second sheet processing configuration including the second roll, the third roll, and the fourth roll being operably positioned for imparting a curl in a sheet in the sheet processing path. Apparatus may include the second roll being a penetrating roll, the penetrating roll being movable toward and away from the sheet processing path.

In an embodiment, apparatus may include the fourth roll being movable toward and away from the sheet processing path. Apparatus may include the fourth roll being positioned away from the sheet processing path in the first sheet processing configuration. Apparatus may include the first roll being movable toward and away from the sheet processing path.

Apparatus may include the first roll being positioned away from the processing path in the second sheet processing configuration.

In an embodiment, the first roll, the second roll, the third roll, and the fourth roll having substantially equal radii. In an embodiment, a first roll and the second may configured to rotate at a substantially equal speed. In an embodiment, apparatus may include a drive gear, the first roll and the second roll being configured for operable engagement with the drive gear. In an embodiment, apparatus may include the drive gear, the first roll, and the second roll being configured for simultaneously driving the first roll and the second roll.

In an embodiment, the third roll and the fourth roll may be configured to rotate at a substantially equal speed. In an embodiment, apparatus may include a drive gear, the third roll and the fourth roll being configured for operable engagement with the drive gear. In an embodiment, apparatus may include the drive gear, the third roll, and the fourth roll being configured for simultaneously driving the third roll and the fourth roll.

An embodiment of selective sheet curling systems may include a sheet feeding assembly, the sheet feeding assembly being configured to feed a sheet to a sheet processing assembly comprising a first roll, a second roll, a third roll, and a fourth roll. The first roll, the second roll, the third roll, and the fourth roll may be selectively engageable. In an embodiment, systems may include the first roll, the second roll, the third roll, and the fourth roll have substantially equal radii. In an embodiment, systems may include the first roll, the second roll, the third roll, and the fourth roll being adjustable to a first processing configuration and a second processing configuration, whereby the first processing configuration accommodates curling a sheet in a first direction, and the second processing configuration accommodates curling a sheet in a second direction.

In an embodiment, systems may include a curl measuring system. The curling measuring system may comprise a sensor for sensing media such as a paper sheet. The sensor may be arranged at a sheet processing path, and may be configured for sensing sheet characteristics. For example, the sensor may be configured for sensing a curl in a sheet. The sensor may be configured to transmit data comprising sheet measurements to a controller.

In an embodiment, systems may include a controller for determining sheet characteristics based on data received form a curl sensor. In an embodiment, systems may include a controller for receiving data from a curl sensor arranged at a sheet processing path, and configured to sense a sheet before the sheet is processed at a four-roll curler apparatus. In an embodiment, systems may include a controller operably connected to a four-roll curl apparatus, and configured to cause a determination of whether to configure the four-roll curler apparatus in a first processing configuration or a second processing configuration. In an embodiment, the controller may be configured to cause the four-roll curler to be configured in a first sheet processing configuration, or a second sheet processing configuration, based on data generated by a curl sensor.

In an embodiment, the controller may be configured to disengage a first exit roll based on data generated by a curl sensor. The controller may be configured to disengage a second inlet roll based on data generated by a curl sensor. Based on data generated by a curl sensor, the data pertaining to a curl in a sheet to be processed at a four-roll curler apparatus, the controller may be configured to cause a change of position of a penetrating roll in a first or second sheet processing configuration.

An embodiment of selective sheet curling methods may include feeding a sheet to a sheet processing assembly, the sheet processing assembly comprising a first roll, a second roll, a third roll, and a fourth roll; selectively engaging three of the four rolls for sheet processing in one of a first processing configuration and a second processing configuration; processing the sheet at the sheet processing assembly; and urging one of three rolls in the configuration against the sheet to impart a curl in the sheet. Methods may include disengaging one of the four rolls, whereby bending the sheet by the disengaged roll is substantially prevented during the processing the sheet at the sheet processing assembly.

In an embodiment, selective sheet curling methods may include measuring sheet curl of a sheet to be processed at a four-roll curler apparatus. For example, a curl sensor may be configured for sensing a sheet. A curl sensor may be configured for measuring and/or generating data for determining characteristics of a sheet, such as a degree of curl.

In an embodiment, methods may include determining whether to configure a four-roll curler apparatus in a first sheet processing configuration or a second sheet processing configuration. For example, a controller may be configured to cause a four-roll curler apparatus to be configured in one of a first sheet processing configuration and a second sheet processing configuration, based on data generated by measuring characteristics of a sheet to be processed. In an embodiment, methods may include, in a first sheet processing configuration, positioning or changing a position of a first inlet roll/second penetrating roll. The position of the first inlet roll/second penetrating roll may be based on data generated from measuring sheet characteristics. In an embodiment, methods may include, in a second sheet processing configuration, positioning or changing a position of a first penetrating roll/second exit roll. The position of the first penetrating roll/second exit roll may be based on data generated from measuring characteristics of a sheet to be processed. In an embodiment, methods may include processing a sheet at a four-roll curler in a first sheet processing configuration and/or a second sheet processing configuration.

Exemplary embodiments are described herein. It is envisioned, however, that any systems that incorporate features of apparatus, systems, and methods described herein are encompassed by the scope and spirit of the exemplary embodiments.

DETAILED DESCRIPTION

Figure 1A:
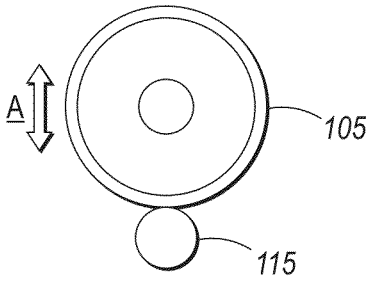
FIG. 1A shows a related art media curler.
Figure 1B:
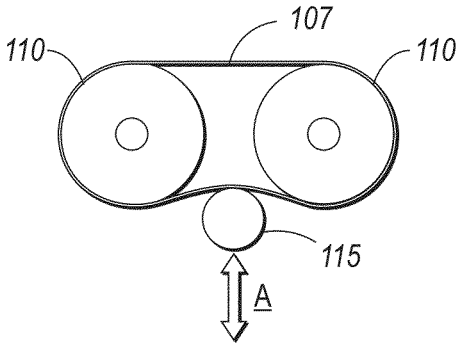
FIG. 1B shows a related art media curler.
Figure 1C:
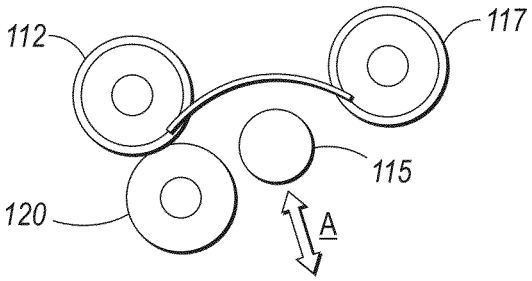
FIG. 1C shows a related art media curler.

Exemplary embodiments are intended to cover all alternatives, modifications, and equivalents as may be included within the spirit and scope of the apparatus and systems as described herein.

Reference is made to the drawings to accommodate understanding of quad or four-roll paper curling and/or decurling apparatus and systems and methods for selective sheet curling. In the drawings, like reference numerals are used throughout to designate similar or identical elements. The drawings depict various embodiments of illustrative four-roll media curling apparatus, systems, and methods.

Four-roll media curling apparatus may include four rolls: a first penetrating roll/second exit roll, a second penetrating roll/first inlet roll, a first exit roll, and a second inlet roll. The four rolls may be configured to have substantially equal radii. The rolls may be formed of solid stainless steel shafts, for example. Each of the four rolls may have a hard surface. The rolls may be arranged so that no baffle interposes the rolls.

The four rolls may include a second penetrating roll/first inlet roll and a first exit roll arranged on a first side of a sheet processing path, and a second inlet roll and a first penetrating roll/second exit roll arranged on a second side of the paper path. The second penetrating roll/first inlet roll and the first exit roll may be configured to contact a first side of a sheet, and the second inlet roll and the first penetrating roll/second exit roll may be configured to contact an second, opposite side of the sheet. For example, a sheet may pass between the first inlet roll/second penetrating roll and the opposing second inlet roll and first penetrating roll/second exit roll in a process direction, e.g., for curling and/or decurling. In apparatus and systems, the four rolls may be configured for accommodating a first processing configuration and a second processing configuration. The first processing configuration, or up-curl configuration, may accommodate imparting a curl in a sheet in a first direction. The second processing configuration, or down-curl configuration, may accommodate imparting a curl in the sheet in a second direction, wherein the second direction may opposite from the first direction. Imparting a curl may include decurling a sheet that may already include a curl.

The first inlet roll/second penetrating roll may be movable, and may be configured to function as a penetrating roll by urging the sheet against the second inlet roll and the first penetrating roll/second exit roll for imparting a curl in the sheet in the first, up-curl configuration. For example, the first inlet roll/second penetrating roll may be movable along a line that runs perpendicular to a line running in a fixed direction and connecting the centers of the second inlet roll and the first penetrating roll/second exit roll. In the up-curl configuration, the first penetrating roll/second exit roll may be configured to perform an exit roll function, and the second inlet roll may be configured to perform an inlet roll function. The first exit roll may be configured for moving away from the sheet processing path in the first sheet processing configuration for sheet processing wherein the sheet is prevented from being substantially bent by the first exit roll.

The first penetrating roll/second exit roll may be movable, and may be configured to function as a penetrating roll by urging the sheet against the first inlet roll/second penetrating roll and the first exit roll for imparting a curl in the sheet in the down-curl configuration. For example, the first penetrating roll/second exit roll may be movable along a line that runs perpendicular to a line running in a fixed direction and connecting the centers of the first inlet roll/second penetrating roll and the first exit roll. In the down-curl configuration, the first exit roll may be configured to perform an exit roll function and the first inlet roll/second penetrating roll may be configured to perform an inlet roll function. The second inlet roll may be configured for moving away from the sheet processing path in the second sheet processing configuration for sheet processing wherein the sheet is prevented from being substantially bent by the second inlet roll.

A gap between an inlet roll and an exit roll may be defined to maintain a distance sufficient, e.g., to reduce a potential for stubbing-related failures. When a stubbing failure occurs, a lead edge of media such as a paper sheet may be stubbed at an exit roll, or may be guided into the gap between an inlet roll and an exit roll, and a paper jam may occur. There are substantially no baffles between the four rolls. Any of the rolls may be selectively engaged. A set of rolls on a first side of a sheet processing path may be configured to rotate in a direction opposite to a direction of rotation of a set of rolls on the second side of the sheet processing path to accommodate transport of the sheet through the sheet processing path of quad-roll media curling apparatus and systems.

In an embodiment of four roll media curling apparatus and systems, each of the first inlet roll/second penetrating roll, second inlet roll, first exit roll, and first penetrating roll/second exit roll may have small radii. Exemplary radii may include radii in a range of, for example, 3 mm to 10 mm. In a preferred embodiment, the rolls may have radii small enough to accommodate curling requirements; the minimum bending radius of paper in a curler is limited by the roll radius.

In an embodiment, the rolls may be rotated at substantially equal speeds, and as paper is fed through gaps, or a processing path, defined by the penetrating rolls and the inlet and exit rolls, the paper may be bent and curled. The degree of bending may be adjusted by changing a position of, for example, a penetrating roll relative to an inlet and an exit roll.

Quad-roll or four-roll media curling apparatus may incorporated into sheet processing systems such as, e.g., printing systems. One or more four-roll media curlers may be implemented in a single sheet processing system. For example, one or more four-roll media curler apparatus may be implemented in a printing system such as a xerographic imaging system.

Figure 2:
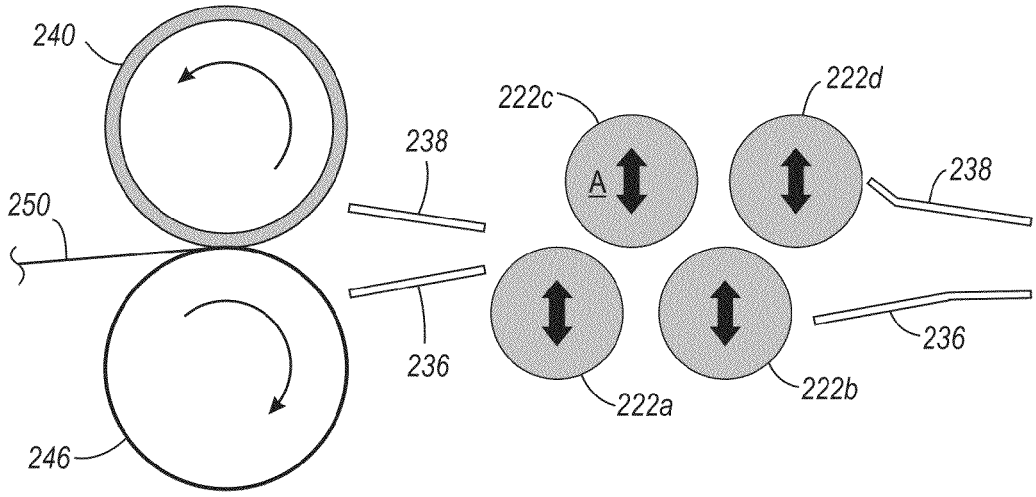
FIG. 2 shows a diagrammatical side view of a four-roll media curler in accordance with an exemplary embodiment.

FIG. 2 shows a diagrammatical side view of a four-roll curling apparatus in accordance with an embodiment. One or more such systems may be implemented in a printing system, for example. The four-roll curling apparatus includes four curler rolls 222*a*-222*d*. The four curler rolls 222*a*-222*d* may be selectively engageable and movable.

The four curler rolls 222*a*-222*d* include a second inlet roll 222*a*, a first penetrating roll/second exit roll 222*b*, a first inlet roll/second penetrating roll 222*c*, and a first exit roll 222*d*. The second inlet roll 222*a* and the first penetrating roll/second exit roll 222*b* may be arranged on a first side of a sheet processing path, and the first inlet roll/second penetrating roll 222*c* and the first exit roll 222*d* may be arranged on a second side of the sheet processing path. The second inlet roll 222*a* and the first penetrating roll/second exit roll 222*b* may be arranged in positions on the first side of the sheet processing path that are opposite and offset from the first inlet roll/second penetrating roll 222*c* and the first exit roll 222*d* positions on the second side of the processing path, as shown in FIG. 2.

Baffles located before and after the four rolls, with respect to a process direction, may be configured for guiding a sheet to and from a sheet processing path defined by the rolls. For example, baffles 236 may be arranged on a first side of the sheet processing path, and baffles 238 may be arranged on a second side of the sheet processing path.

Radii of the four rolls 222*a*-222*d* may be substantially equal. The radii may be small so as to accommodate a paper path effective for curling. The rolls may be configured so that a distance between a penetrating roll and an inlet roll is substantially equal to a distance between the penetrating roll and an exit roll. The penetrating rolls may be adjustable in direction(s) shown by arrows "A" of FIG. 2. Similarly, the first exit roll 222*d* and the second inlet roll 222*a* may be adjustable in directions shown by arrows "A" for arranging the rolls out of operable positions, and away from the sheet processing path. The direction of movement of the adjustable rolls is not limited to the direction indicated by arrows "A".

The four rolls 222*a*-222*d* may be adjustable to a first processing configuration, or up-curl configuration, whereby a curl may be imparted in a sheet in a first direction. In the first or up-curl configuration, a distance between a first inlet roll/second penetrating roll 222*c* and the second inlet roll 222*a* may be about the same as the distance between the first inlet roll/second penetrating roll 222*c* and the second exit roll/first penetrating roll 222*b*. The distance between these three rolls in the first configuration may be adjusted by moving their relative positions. For example, first inlet roll/second penetrating roll 222*c* may be moved in directions corresponding, for example, to the directions of the double-headed arrow "A" of FIG. 2. The first curler configuration may be a curl configuration that imparts a curl in a first direction, e.g., an up-curl in a sheet processed by the curling apparatus.

A first exit roll 222*d* may be placed out of curling operation during a sheet processing operation using a curling apparatus in a first configuration. A first exit roll 222*d* may be configured to be out of curling operation by way of rotating the first exit roll 222*d* relative to the first inlet roll/second penetrating roll 222*c*, or by moving the first exit roll 222*d* away from the sheet processing path for sheet processing. Accordingly, a sheet processed for curling may be prevented from being substantially bent by the first exit roll 222*d* during processing.

The plurality of rolls may be adjustable to a second processing configuration, or down-curl configuration, whereby a curl may be imparted in a sheet in a second direction. In the second or down-curl configuration, a distance between a first penetrating roll/second exit roll 222*b* and the first inlet roll/second penetrating roll 222*c* may be about the same as the distance between the first penetrating roll/second exit roll 222*b* and the first exit roll 222*d*. The distance between the first penetrating roll/second exit roll 222*b* and the first inlet roll/second penetrating roll 222*c* and the first exit roll 222*d* in the second configuration may be adjusted by moving the first penetrating roll/second exit roll 222*b* in directions corresponding to the double-headed arrow "A" of FIG. 2. The second processing configuration may be a curl configuration that imparts a down-curl in a sheet processed by the curling apparatus.

A second inlet roll 222*a* may be placed out of curling operation during a sheet processing operation using a curling apparatus in a second processing configuration. For example, a second inlet roll 222*a* may be configured to be out of curling operation by way of rotating the second inlet roll 222*a* relative to the first penetrating roll/second exit roll 222*b*, or by moving the second inlet roll 222*a* away from the sheet processing path for sheet processing. Accordingly, a sheet processed for curling may be prevented from being substantially bent by the second inlet roll 222*a* during processing.

Four-roll media curling apparatus and systems may be selectively configurable for operation in either a first sheet processing configuration or a second sheet processing configuration to impart a curl in a sheet in a desired direction. For example, four-roll media curling apparatus may impart a curl in a sheet in a first direction using the first sheet processing configuration, and a curl in the sheet in a second direction using the second sheet processing configuration. The second direction may be a direction that is opposite to a first direction.

In an embodiment of systems, a curling apparatus may be implemented with a first feed roll 240 and a second feed roll 246, which together may form a nip by which paper 250 may be fed to an inlet of the four-roll curling apparatus comprising the first inlet roll/second penetrating roll 222*c* and/or the second inlet roll 222*a*. The paper 250 may be compressed by the rolls, bent, and curled before passing the exit of the four-roll curling apparatus comprising the first exit roll 222*d* and the first penetrating roll/second exit roll 222*b*. The first feed roll 240 and the second feed roll 246 may comprise driver and idler rolls.

Surfaces of the four-roll curling apparatus and systems may be hard. For example, rolls 222*a*-222*d* may be hard rolls. A surface of the rolls may comprise stainless steel, for example. The rolls may have substantially equal radii.

The first exit roll 222*d* may be arranged in a position that is fixed with respect to the position of the first inlet roll/second penetrating roll 222*c*. The distance therebetween may be minimized to, e.g., avoid stubbing. For example, a first inlet roll/second penetrating roll 222*c* and a first exit roll 222*d* may be arranged to be spaced about 1 mm apart. Similarly, the second inlet roll 222*a* may be arranged in a position that is fixed with respect to the position of the first penetrating roll/second exit roll 222*b*.

A degree of bending of media such as a paper may be adjusted by moving at least the first penetrating roll/second exit roll 222*b*, or the second penetrating roll/first inlet roll 222*c*, depending on the current processing configuration. The assembly of the first inlet roll/second penetrating roll 222*c* and the first exit roll 222*d* may be adjustable for changing a distance between the first inlet roll/second penetrating roll 222*c* and the first exit roll 222*d*, and the second inlet roll 222*a* and the first penetrating roll/second exit roll 222*b*.

A plurality of the curler rolls 222*a*-222*d* may be rotated at a same circumferential speed to feed the paper 250 in a desired direction. For example, to feed the paper 250 from left to right, with respect to FIG. 2, the first inlet roll/second penetrating roll 222*c* and/or the first exit roll 222*d* may be rotatable in a counterclockwise direction sheet processing, while the second inlet roll 222*a* and/or the first penetrating roll/second exit roll 222*b* may be rotatable in a clockwise direction for sheet processing. In an embodiment, because the first inlet roll/second penetrating roll 222*c* and the first exit roll 222*d* may be configured to be driven in the same direction, e.g., in a second sheet processing configuration, they may share the same drive gear system. Similarly, the second inlet roll 222*a* and the first penetrating roll/second exit roll 222*b* may be configured to be driven in the same direction by a same drive gear system.

In an embodiment of systems, a controller (not shown) may be configured to cause the four-roll curler apparatus to be configured in at least one of at least a first processing configuration and a second processing configuration. The controller may be configured to determine whether to cause the four-roll curler apparatus to be implemented in the first sheet processing configuration or the second sheet processing configuration. For example, the controller may determine whether to proceed in a particular processing configuration based on data pertaining to a sheet to be processed at the four-roll curler apparatus. Systems may include a curl sensor (not shown) operably positioned at a sheet processing path, and configured to sense a sheet for measuring sheet curl. The controller may be connected to the sensor for receiving data comprising and/or based on the sensed curl measurement. The controller may be configured to process a sheet at the four-roll curler apparatus using the apparatus in multiple processing configuration for same sheet for imparting multiple and bi-direction curls as desired, and/or based on sensed sheet curl measurement data.

Figure 3A:
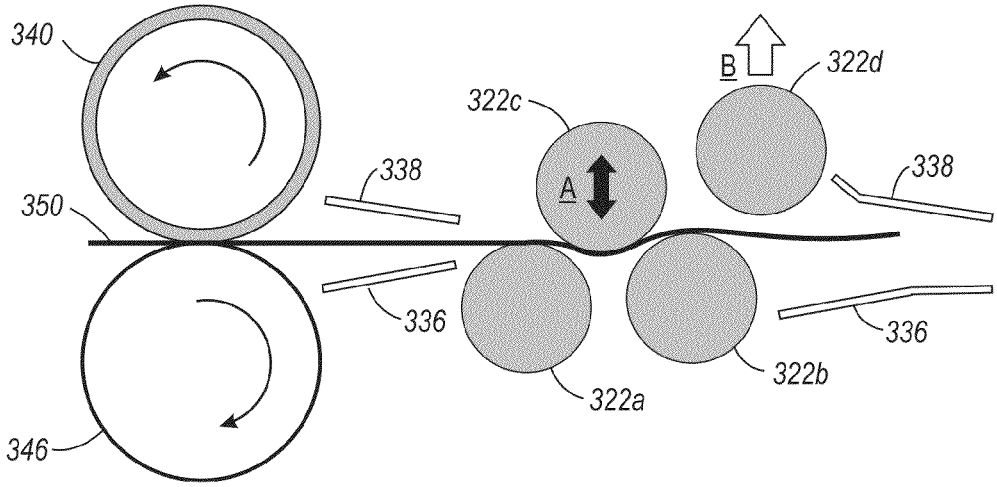
FIG. 3A shows a diagrammatical side view of a four-roll media curler configured for imparting a upward curl in accordance with an exemplary embodiment.

FIG. 3A shows a diagrammatical view of a four-roll curler apparatus arranged in a first sheet processing configuration, and configured for imparting an up-curl in a sheet. One or more such apparatus may be implemented in a sheet processing system, such as a printing system, for example. The four-roll curler apparatus includes four curler rolls 322*a*-322*d*. The rolls may be adjustable to a first processing configuration or up-curl configuration as shown, whereby a curl may be imparted in a sheet in a first direction. In the up-curl configuration, a distance between a first inlet roll/second penetrating roll 322*c* and the second inlet roll 322*a* may be about the same as the distance between the first inlet roll/second penetrating roll 322*c* and the first penetrating roll/second exit roll 322*b*. The distance between these three rolls in the first configuration may be adjusted by changing the relative positions of the rolls. For example, the first inlet roll/second penetrating roll 322*c* may be moved in directions corresponding to the directions of the double-headed arrow "A" of FIG. 3A.

The first curler configuration may be a curl configuration that imparts a curl in a first direction, e.g., an up-curl in a sheet processed by the curling apparatus. A first exit roll 322*d* may be placed out of curling operation during a sheet processing operation using a curling apparatus arranged in a first configuration. A first exit roll 322*d* may be configured to be out of curling operation by way of rotating the first exit roll 322*d* relative to the first inlet roll/second penetrating roll 322*c*, or by moving the first exit roll 322*d* away from the sheet processing path for sheet processing. For example, the first exit roll 322*d* may be moved upward in the direction of arrow "B," away from the sheet processing path. Accordingly, a sheet processed for curling may be prevented from being substantially bent by the first exit roll 322*d* during processing.

A sheet 350 may be fed by feed rolls 340 and 346 to pass through and contact the second inlet roll 322*a*, the first inlet roll/second penetrating roll 322*c*, and the first penetrating roll/second exit roll 322*b*. The sheet 350 may be a paper sheet, or other suitable media. The first inlet roll/second penetrating roll 322*c* may be urged against sheet 350 during processing to cause the sheet 350 to contact the second inlet roll 322*a* and the first penetrating roll/second exit roll 322*b* to impart a curl in the sheet 350. The sheet may exit the apparatus at the first penetrating roll/second exit roll 322*b*. As shown in FIG. 3A, the first exit roll 322*d* is out of curling operation, and positioned away from the processing path along which the sheet 350 is fed. Accordingly, as the sheet 350 may exit the curling apparatus configured for sheet processing in a first processing configuration without being substantially bent by the first exit roll 322*d*.

Baffles located before and after the four rolls, with respect to a process direction, may be configured for guiding a sheet to and from a sheet processing path defined by the rolls. For example, baffles 336 may be arranged on a first side of the sheet processing path, and baffles 338 may be arranged on a second side of the sheet processing path.

Figure 3B:
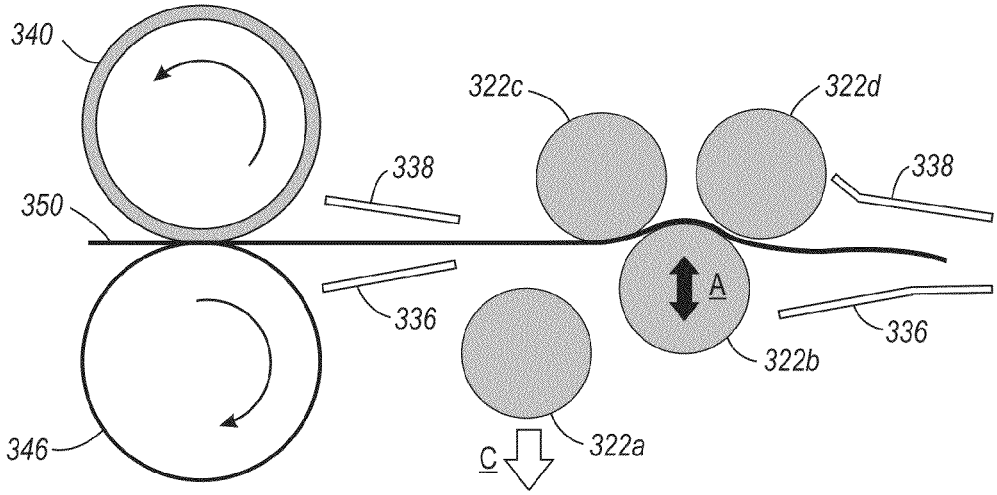
FIG. 3B shows a diagrammatical side view of a four-roll media curler configured for imparting an downward curl in accordance with an exemplary embodiment.

FIG. 3B shows a diagrammatical view of a four-roll curler apparatus arranged in a second sheet processing configuration, and configured for imparting a down-curl in a sheet. One or more such apparatus may be implemented in a sheet processing system, such as a printing system, for example. The rolls may be adjustable to a second processing configuration or down-curl configuration as shown, whereby a curl may be imparted in a sheet in a second direction, e.g., a direction that is substantially opposite to the first direction discussed above with regard to FIG. 3A. In the second or down-curl configuration, a distance between a first penetrating roll/second exit roll 322*b* and a first inlet roll/second penetrating roll 322*c* may be about the same as the distance between the first penetrating roll/second exit roll 322*b* and the first exit roll 322*d*. The distance between these three rolls in the second processing configuration may be adjusted by moving the first penetrating roll/second exit roll 322*b* in directions corresponding to the directions of the double-headed arrow "A" of FIG. 3B. The second processing configuration may be a curl configuration that imparts a curl in a second direction, e.g., a down-curl in a sheet processed by the curling apparatus.

A second inlet roll 322*a* may be placed out of curling operation for sheet processing operation using a curling apparatus arranged in a second configuration. A second inlet roll 322*a* may be configured to be out of curling operation by way of rotating the second inlet roll 322*a* relative to the first penetrating roll/second exit roll 322*b*, or by moving the second inlet roll 322*a* away from the sheet processing path for sheet processing. For example, the second inlet roll 322*a* may be moved downward in the direction of arrow "C," away from the sheet processing path. Accordingly, a sheet processed for curling may be prevented from being substantially bent by the second inlet roll 322*a* during processing.

For example, a sheet 350 may be fed by feed rolls 340 and 346 to pass through the curler apparatus and contact the first inlet roll/second penetrating roll 322*c*, the first penetrating roll/second exit roll 322*b*, and the first exit roll 322*d*. The first penetrating roll/second exit roll 322*b* may be urged against sheet 350 during processing to cause the sheet 350 to contact the first inlet roll/second penetrating roll 322*c* and the first exit roll 322*d* to impart a curl in the sheet 350. The sheet may exit the apparatus at the first exit roll 322*d* As shown in FIG. 3B, the second inlet roll 322*a* is out of curling operation, and positioned away from the processing path along which the sheet 350 is fed. Accordingly, the sheet 350 may enter and pass through the curling apparatus configured for sheet processing in a second processing configuration without being substantially bent by the second inlet roll 322*a*.

Baffles located before and after the four rolls, with respect to a process direction, may be configured for guiding a sheet to and from a sheet processing path defined by the rolls. For example, baffles 336 may be arranged on a first side of the sheet processing path, and baffles 338 may be arranged on a second side of the sheet processing path.

Curling/decurling sheet processing methods may include processing a sheet using a bi-directional four-roll curling apparatus or system. Methods may include imparting curl in a sheet in at least one of a first direction and a second direction by selectively engaging three of the four rolls to operate in one of the sheet processing configurations. For example, to impart a curl in a sheet in a first direction using a four-roll curling apparatus or system, a second inlet roll, a first inlet roll/second penetrating roll, and a first penetrating roll/second exit roll may be engaged for imparting a curl in a sheet in a first direction. The first inlet roll/second penetrating roll may be urged against a sheet passing between the first inlet roll/second penetrating roll and the second inlet roll and the first penetrating roll/second exit roll. The sheet may be caused to contact the second inlet roll and the first penetrating roll/second exit roll whereby a sheet is caused to bend, imparting a curl in the sheet, the curl extending in a first direction. In an embodiment, before imparting the curl in the sheet by urging the first inlet roll/second penetrating roll against the sheet, the first exit roll may be selectively moved away from a processing path for the first processing configuration, whereby the sheet is prevented from being substantially bent by the first exit roll.

To impart a curl in a sheet in a second direction using a four-roll curling apparatus or system, a first inlet roll/second penetrating roll, a first penetrating roll/second exit roll, and a first exit roll may be engaged for imparting a curl in a sheet in a second direction. The first penetrating roll/second exit roll may be urged against a sheet passing between the first penetrating roll/second exit roll and the first inlet roll/second penetrating roll and the first exit roll. The sheet may be caused to contact the first inlet roll/second penetrating roll and the first exit roll whereby the sheet is caused to bend, imparting a curl in the sheet, the curl extending in a second direction. The second direction may be different, e.g., substantially opposite from the first direction. In an embodiment, before imparting the curl in the sheet by urging the first penetrating roll/second exit roll against the sheet, the second inlet roll may be selectively moved away from a processing path for the second processing configuration, whereby the sheet is prevented from being substantially bent by the second inlet roll.

Figure 4:
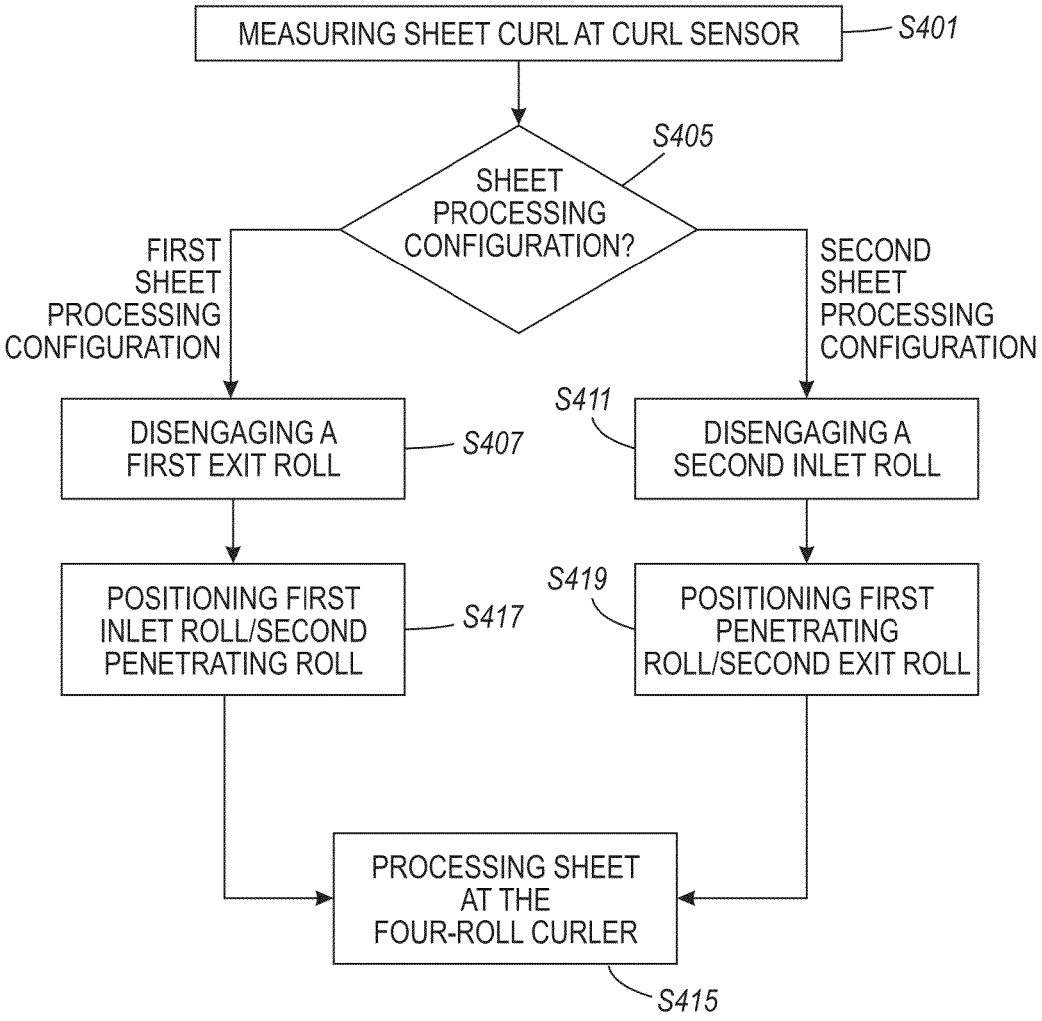
FIG. 4 shows methods for selective sheet curling in accordance with an exemplary embodiment.

For example, methods for selective sheet curling using four roll curler apparatus and systems are shown in FIG. 4. Methods for sheet curling may include measuring characteristics of a sheet to be processed at a four-roll curler apparatus. Methods may include sensing a sheet to be curled at S401. A sensor operably positioned at the sheet processing path may be configured for measuring sheet curl before the sheet is processed by the four roll curler. Before the sheet is processed at the four-roll curler apparatus, methods may include, based on sheet curl measurement sensed at S401, determining whether to configure the four-roll curler apparatus in one of a first sheet processing configuration and a second sheet processing configuration at S405.

The first sheet processing configuration may be an up-curl configuration wherein a second inlet roll, first inlet roll/second penetrating roll, and first penetrating roll/second exit roll are engaged and positioned about a sheet processing path as shown in, e.g., FIG. 3A. The second processing configuration may be a down-curl configuration wherein a first inlet roll/second penetrating roll, first penetrating roll/second exit roll, and first exit roll are engaged and positioned about a sheet processing path as shown in FIG. 3B. The first sheet processing configuration may impart a curl in a sheet extending in a first direction, and the second sheet processing configuration may impart a curl in a sheet extending in a second direction that is different from the first direction. The first or second processing configuration may be selected as desired for a particular print job. For example, the first processing configuration may be used to impart curl in a first sheet, and the second processing configuration may be used to impart curl in a second sheet. Further, the first processing configuration may used to impart curl in a sheet extending in a first direction, and the second processing configuration may used to impart curl in a sheet, the curl extending in a second direction that is different from the first direction.

In an embodiment, the processing configuration may be determined at S405 based upon data generated from a sensor positioned and configured to sense at S401 a sheet to be processed. The sensor may be configured to measure curl of the sheet. A controller may be configured for the determining at S405 whether to configure the four-roll curler apparatus in a first sheet processing and/or a second sheet processing configuration for processing a sheet based on the data generated by the curl sensor.

Methods may include causing a four-roll curler apparatus to be in a first sheet processing configuration or a second sheet processing configuration. A sheet processing configuration may be determined at S405. The sheet processing configuration may be determined based on measuring the sheet at S401. If a first processing configuration is selected at S405 so that three of the four rolls engaged include the second inlet roll, first inlet roll/second penetrating roll, and the first penetrating roll/second exit roll, the first exit roll may be disengaged from curling operation at S407 by, e.g., moving the first exit roll away from the sheet processing path. Alternatively, if a second processing configuration is selected at S405 so that three of the four rolls engaged include the first inlet roll/second penetrating roll, the first exit roll, and the first penetrating roll/second exit roll, the second inlet roll may disengaged from curling operation at S411.

Methods may include positioning, e.g., changing a position of, a first inlet roll/second penetrating roll at S417 if a first sheet processing configuration is determined at S405. At S417, the first inlet roll/second penetrating roll may be positioned based on data from measuring sheet characteristic(s) at S401 of a sheet to be processed in the first processing configuration determined at S405.

Methods may include positioning, e.g., changing a position of, a first penetrating roll/second exit roll at S419 if a second sheet processing configuration is determined at S405. At S419, the first penetrating roll/second exit roll may be positioned based on data from measuring sheet characteristic(s) at S401 of a sheet to be processed in the second processing configuration determined at S405. After the curler is positioned in the configuration determined at S405, a sheet may be received at the curler and processed at S415, imparting a curl in the desired direction. Methods may be implemented for imparting multiple curls in a single sheet, and for imparting multiple curls in a single sheet, wherein the multiple curls may be imparted in directions that are different from one another.

While apparatus, systems, and methods are described in relationship to exemplary embodiments, many alternatives, modifications, and variations would be apparent to those skilled in the art. Accordingly, embodiments of apparatus, systems, and methods as set forth herein are intended to be illustrative, not limiting. There are changes that may be made without departing from the spirit and scope of the exemplary embodiments.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A printing system, comprising:

a sheet processing assembly configured to curl or decurl a sheet, the sheet processing assembly comprising a first roll, a second roll, a third roll, and a fourth roll, the first roll and the second roll being arranged to face a first side of a sheet being curled or decurled by the sheet processing assembly, the third roll and the fourth roll being arranged to face a second side of the sheet, wherein the first roll and the second roll are arranged opposite to and offset from, and overlapping the third and fourth rolls, wherein the first roll, the second roll, the third roll, and the fourth roll are configured to move in directions substantially perpendicular to their respective rotational axes and wherein the first roll, the second roll, the third roll, and the fourth roll are selectively engageable to move at least three rolls toward or away from the sheet to curl or decurl the sheet by contacting the sheet with three of the four rolls, the first, the second, the third, and the fourth roll defining a sheet processing path; and a sheet feeding assembly, the sheet feeding assembly being configured to feed a sheet to the sheet processing assembly.

2. The system of claim 1, comprising the fourth roll being positioned away from the sheet processing path in the first sheet processing configuration.

3. The system of claim 1, comprising the first roll being positioned away from the sheet processing path in the second processing configuration.

4. The system of claim 1, wherein the first roll and the second roll are configured to rotate at a substantially equal speed.

5. The system of claim 1, comprising:

a drive gear, the first roll and the second roll being configured for operable engagement with the drive gear.

6. The system of claim 1, wherein the drive gear, the first roll, and the second roll are configured for simultaneously driving the first roll and the second roll.

7. The system of claim 1, wherein the first roll, the second roll, the third roll, and the fourth roll have substantially equal radii.

8. The system of claim 1, comprising the first roll, the second roll, the third roll, and the fourth roll being adjustable to a first processing configuration and a second processing configuration, whereby the first processing configuration accommodates curling a sheet in a first direction, and the second processing configuration accommodates curling a sheet in a second direction.

9. The system of claim 8, comprising the first processing configuration including the first roll, the second roll, and the third roll being operably positioned for imparting a curl in a sheet in the sheet processing path.

10. The system of claim 8, comprising the second sheet processing configuration including the second roll, the third roll, and the fourth roll being operably positioned for imparting a curl in a sheet in the sheet processing path, the second roll, the third roll, and the fourth roll being the at least three rolls.

* * * * *